US006051182A

United States Patent [19]

Albarran et al.

[11] Patent Number: 6,051,182

[45] Date of Patent: Apr. 18, 2000

[54] APPARATUS AND PROCESS FOR THE DIRECT REDUCTION OF IRON OXIDES

[75] Inventors: Wolfgang A. Albarran, Manzana; Adersido De Jesús Gomez; Oscar G. Dam, both of Estado Bolivar, all of Venezuela

[73] Assignee: Brifer International Ltd., Bridgetown, Barbados

[21] Appl. No.: 09/010,300

[22] Filed: Jan. 21, 1998

[51] Int. Cl.[7] ..... C21B 7/22

[52] U.S. Cl. ..... 266/157; 266/161; 55/434.1; 55/434.2; 55/434.4; 55/434.3

[58] Field of Search ..... 266/161, 157; 55/434.2, 434.3, 434.4, 434.1

[56] References Cited

U.S. PATENT DOCUMENTS

| | | | |
|---|---|---|---|
| 2,805,144 | 9/1957 | Stotler . | |
| 3,053,648 | 9/1962 | Stephens et al. | 75/744 |
| 4,125,385 | 11/1978 | Rado et al. | 55/434.1 |
| 4,806,154 | 2/1989 | Hauk | 75/10.19 |
| 5,873,926 | 2/1999 | Kepplinger et al. | 75/444 |

FOREIGN PATENT DOCUMENTS

| | | |
|---|---|---|
| 0298671 | 1/1989 | European Pat. Off. . |
| 0457983 | 11/1991 | European Pat. Off. . |
| 0628345 | 12/1994 | European Pat. Off. . |

*Primary Examiner*—George Wyszomierski
*Assistant Examiner*—Tima McGuthry-Banks
*Attorney, Agent, or Firm*—Bachman & LaPointe, P.C.

[57] ABSTRACT

A separator for use in a direct reduction reactor comprises an elongated tubular housing having a cooling chamber for receiving a cooling medium for cooling the internal wall surface of the separator contacted by metallized iron fines.

9 Claims, 2 Drawing Sheets

APPARATUS AND PROCESS FOR THE DIRECT REDUCTION OF IRON OXIDES

BACKGROUND OF THE INVENTION

The present invention relates to an apparatus and process for the direct reduction of iron oxides and, more particularly, a separator for use in the apparatus and process for separating out metallized iron fines from a stream of hot gases employed in the process.

It is well known in the art of steelmaking to employ processes for the direct reduction of iron containing metals with the object of obtaining metallized iron fines. Such a process and apparatus is disclosed in U.S. Pat. No. 5,082,251. In the process and apparatus disclosed in the '251 patent, a plurality of reduction reactors are connected in series and are used for the sequential reduction of a raw iron ore feed. It is not uncommon in prior art processes and apparatus to employ separators in the reduction reactors for separating out the metallized iron fines from the stream of hot gases used during the reduction process so as to obtain the iron fines which are serially transferred from reactor to reactor. A typical separator used in the processes and apparatus of the prior art is described and shown in U.S. Pat. No. 4,756,729 and U.S. Pat. No. 3,675,401.

Typically, the apparatus for separating out metallized iron fines is constructed from a cylindrical body into which a suspension composed of the solid particles and gas enters tangentially. The gas entrained with the solid particles moves through the cylindrical body in a spiral manner generated by the action of centrifugal force due to the tangential injection of the gas stream. The gas stream with entrained solid particles is then conveyed to a conical extension of the cylindrical body of the separator. The gas stream is accelerated in the conical region wherein the vortex disintegrates and the solid entrained particles are separated out from the gas stream. The particle-free gas stream moves, in a reverse spiral, towards a central orifice in the top of the equipment and the separated solid particles are expelled by a discharge outlet located in the bottom of the separator.

The apparatus for separating out solid particles from stream of hot gases as described above and employed in processes for the direct reduction of iron containing metals suffers from a number of disadvantages. Firstly, the metallized iron fines tend to collect as solid crusts on the inner walls of the equipment, for example, the conical section, which leads to a change in the equipment geometry which ultimately adversely affects throughput of the reduction reactor. Secondly, the metallized iron fines which are separated out as a result of the acceleration in the centrifugal force in the conical region of the equipment may attain a degree of plasticity (due to the high temperature process) which causes them to adhere to the inner walls of the body of the separator thereby reducing equipment capacity to separate out solid particles from the gas stream.

Accordingly, it is the principle object of the present invention to provide an improved apparatus for use in reduction reactors used in processes for the direct reduction of iron containing metals.

It is a particular object of the present invention to provide an improved separator for separating out metallized iron fines from streams of process gases employed in processes and apparatus for the direct reduction of iron oxides.

It is a still further object of the present invention to provide a separator as aforesaid which prohibits the formation of solid crusts on the inner walls of the separator thereby resulting in geometric integrity of same.

It is an again still further object of the present invention to provide a separator as aforesaid which is efficient in separating out metallized iron fines for process gas streams whereby the separated out metallized iron fines are easily expelled from the separator for further processing.

Further objects and advantages of the present invention will be made clear hereinbelow.

SUMMARY OF THE INVENTION

The foregoing objects are achieved by the present invention wherein a reduction reactor includes a separator located within the reduction zone of the reactor for separating out metallized iron fines from hot gases fed to the reactor. In accordance with the present invention, the separator comprises at least one elongated tubular housing having a sidewall portion defining a passage for the metallized iron fines and hot gases wherein at least a portion of the sidewall portion of the separator includes a cooled area to prevent sticking of the metallized iron fines on the cooled sidewall portion of the separator.

In accordance with a further feature of the present invention, the sidewall portion of the reactor comprises a substantially cylindrical upper portion, a substantially cylindrical lower portion, and a conical intermediate portion connecting the upper portion with the lower portion. In accordance with a preferred feature of the present invention the conical portion of the sidewall forms an angle $\alpha$ of the between about 7° to about 12° with respect to the cylindrical sidewall portion of the lower cylindrical portion. In a preferred embodiment of the present invention, the conical intermediate portion is provided with an internal chamber for receiving a cooling medium under pressure so as to cool the sidewall portion of the conical intermediate portion contacted by the metallized iron fines. The cooled sidewall portion of the separator is cooled to a temperature sufficient to prevent sticking of the metallized iron fines thereto. In accordance with the present invention the cooling medium introduced into the chamber should be at a temperature of about between 30° C. to 600° C.

DETAILED DESCRIPTION

Figure 1:
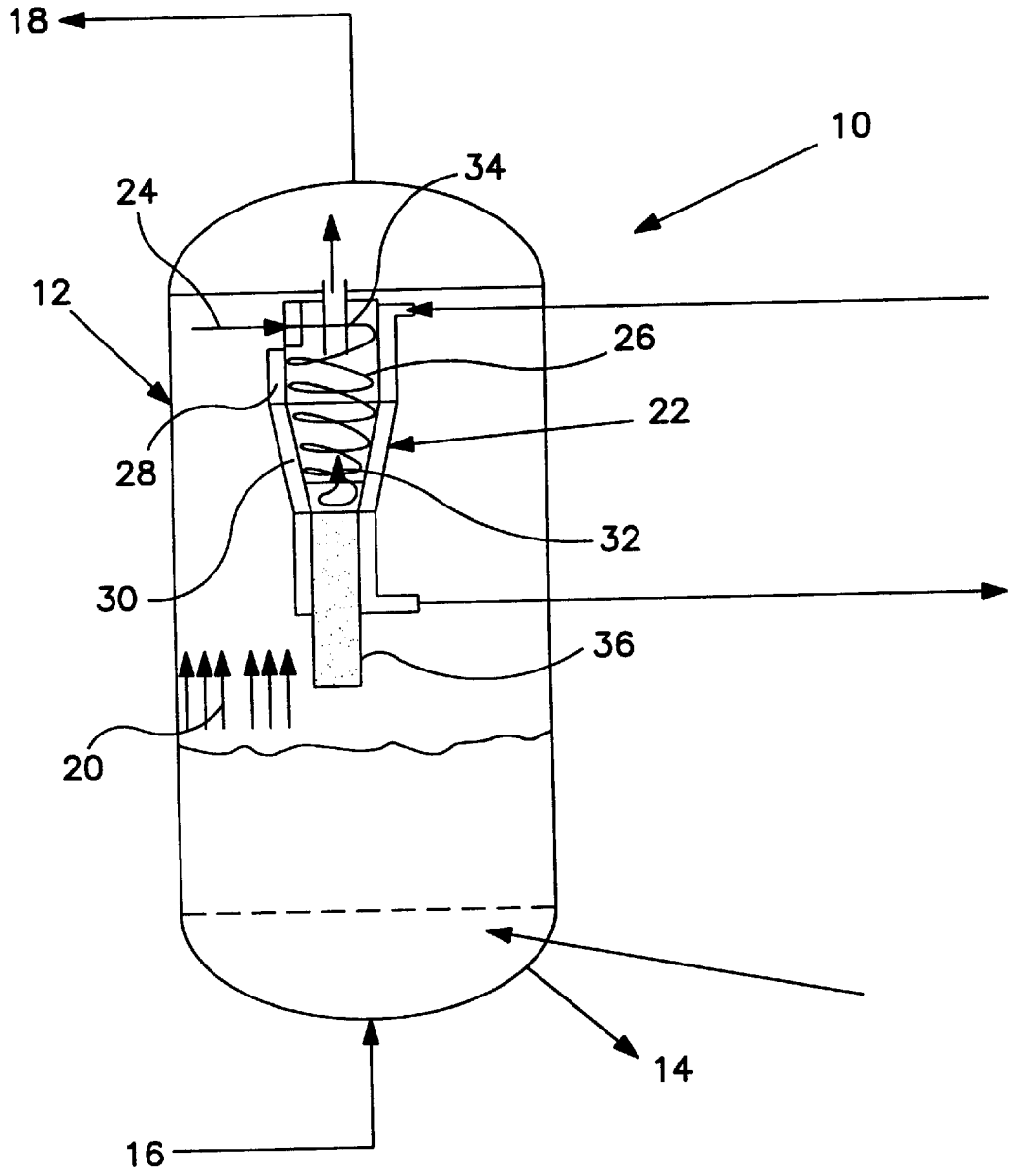
FIG. 1 is a cross-sectional view of a reactor used for the direction reduction of iron oxide particles which employs a separator in accordance with the present invention.

With reference to FIG. 1, a reactor 10 for use in the direct reduction of iron oxide is illustrated schematically in cross-section.

The reactor 10 comprises an iron oxide inlet 12 in an iron oxide outlet 14. Process gases used to reduce the iron oxide particles to metallized iron fines are introduced into the bottom reactor via feed line 16 and exit the reactor via line 18. The process gases flow generally upward in the reactor 10 as illustrated by the arrows 20. The reactor 10 may be a single reactor or, alternatively, maybe one of a series of reactors such as described in U.S. Pat. No. 5,082,251, referred to above.

Within the reactor 10 is separator 22 which is used to separate out the metallized iron fines from the stream of hot process gases passed through the reactor 10.

As can best be seen in FIG. 1, a suspension composed of the solid iron ore particles in gas enters the separator 22 tangentially via inlet 24. The gas entrained with the solid particles moves through the cylindrical body in a spiral manner as schematically illustrated by reference numeral 26 by the action of the centrifugal force due to the tangential injection of the gas stream. The gas stream which moves through the cylindrical body 28 is conveyed to the conical extension 30 of the separator. The gas stream is accelerated in the conical region 30 wherein the vortex disintegrates and the solid entrained particles are separated out from the gas stream. The particle-free gas stream moves in reverse spiral as illustrated by reference numeral 32 towards a central orifice 34 in the top of the separator and the separated metallized particle fines are expelled out a discharge outlet 36 located in the bottom of the separator. To this extent, the separator 22 functions as a typical prior art separator of the type disclosed in U.S. Pat. No. 4,756,729.

Figure 2:
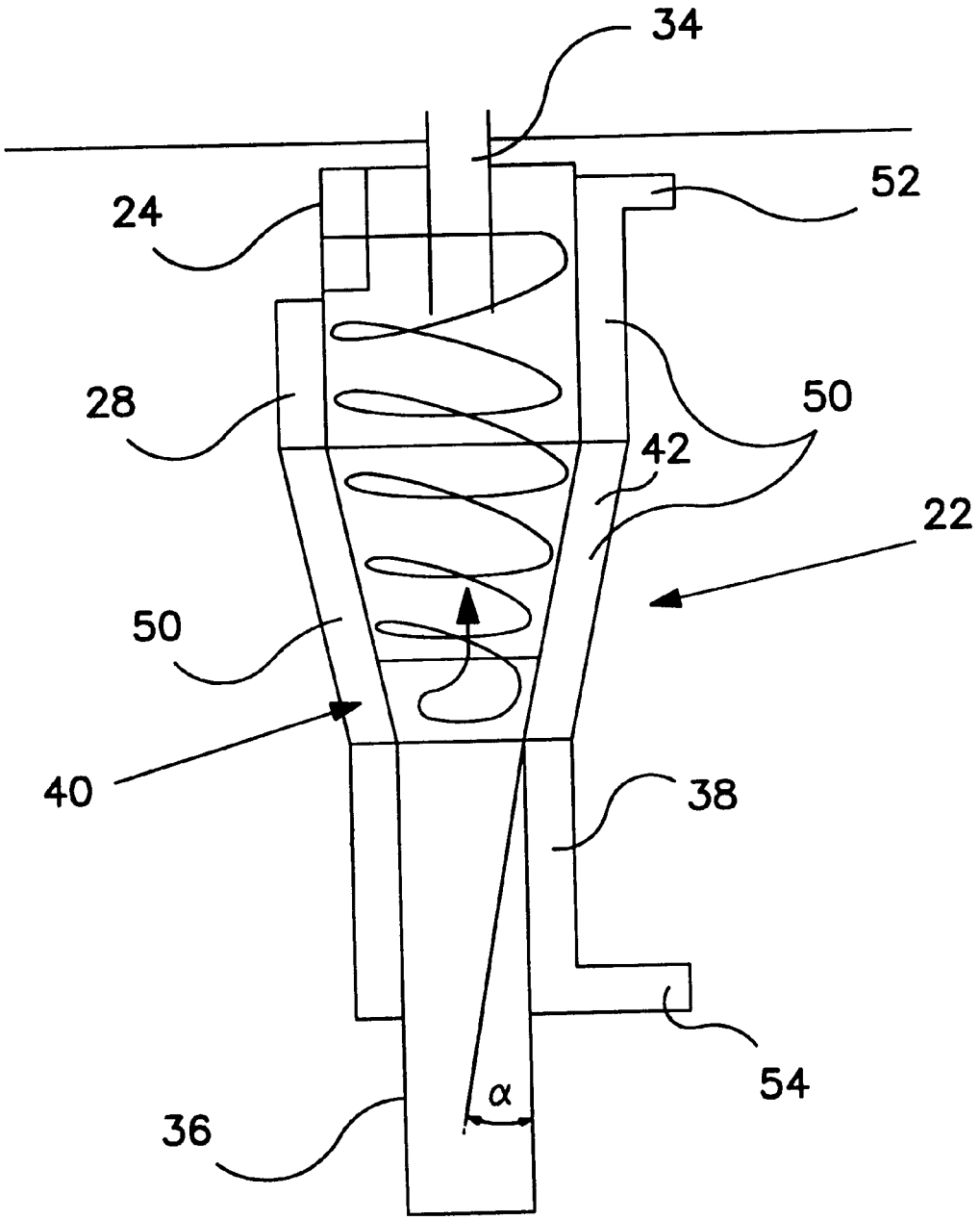
FIG. 2 is a enlarged view of the separator of the present invention for separating metallized iron fines from streams of process gases.

With reference to FIG. 2, the improved separator 22 of the present invention will be described in detail. The separator 22 comprises an elongated tubular housing generally indicated by reference numeral 40. The housing 40 has a substantially cylindrical upper portion 28 and a substantially cylindrical lower portion 38. The upper and lower cylindrical portions are connected by a conical intermediate portion 42. The housing is provided with a tangential inlet 24 located in the upper cylindrical portion 28. A gas outlet is located along the axes of the elongated tubular housing in the upper section 28. An outlet 36 for the metallized iron fines is located int he lower cylindrical portion 38.

With particular reference to FIG. 2, in accordance with the present invention, the cylinder housing includes, at least in part, a hollow annular chamber 50. The annular chamber should be formed in at least the conical intermediate portion 42 of the housing. Preferably, the annular chamber includes not only the conical intermediate portion 42 but the upper and lower cylindrical portions 28 and 38 respectively as shown in FIG. 2. The annular chamber includes a cooling medium inlet 52 and a cooling medium outlet 54 for introducing and removing a cooling medium from the cooling chamber. The cooling medium is preferably introduced to inlet 52 at a temperature of between about 30° C. to 600° C. so as to maintain the temperature of the inner wall contacted by the metallized iron fines at a temperature of less than or equal to 700° C. By maintaining the inner wall of the separator at a temperature of less or equal to 700° C., the metallized iron fines are prevented from sticking to the surface of the sidewall portion of the separator housing which defines the inner wall surface.

In addition to cooling the sidewall portion of the elongated tubular housing of the separator, the conical sidewall portion forms an angle $\alpha$ as shown in FIG. 2 of the between about 7° to 12° with respect to the lower portion of the sidewall. Preferably the angle $\alpha$ is between 8° to 10°. The angle $\alpha$ of the conical section is critical for increasing the efficiency of the solid particle separation and removal from the separator. In addition to the foregoing, the diameter of the discharge section 38 in combination with the angle of the conical section has a synergistic effect with respect to the separation of the metallized fines from the process gases. The diameter of the discharge section 36 is preferably between 16–24 inches. The diameter of the discharge section 38 in combination with the angle of the conical section 42 enhances the separation of the metallized particles at the point where the vortex decreases (as discussed above) thereby enhancing particle separation. The enhanced particle separation in combination with the cooling of the sidewall portions of the separator leads to a high through put and enhanced particle recovery when compared to separators used in the prior art.

The cooling medium used in the process and apparatus of the present invention may be a gas or a liquid. A preferable cooling medium is gas. In accordance with the process of the present invention it is critical that the internal wall surface of the separator contacted by the metallized iron fines be at a temperature of less than or equal to 700° C. In order to obtain the foregoing it has been found that the cooling medium should be at a temperature of between about 30° C. to 600° C. when introduced into the annular cooling chamber 50 through inlet 52.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for the direct reduction of iron oxides comprising:

a reactor defining a reduction zone, said reactor zone having a gas inlet, a gas outlet, an iron oxide particle inlet and a metallized iron fines outlet; and separator means located within said reduction zone for separating out metallized iron fines from hot gases fed to the reactor, said separator means comprises an inlet for a stream of said hot gases and metallized iron fines and at least one elongated tubular housing having a sidewall portion defining a passage for said metallized iron fines and hot gases, said sidewall portion having a conical portion and includes a cooling means for receiving a cooling medium for cooling at least the conical portion of said sidewall portion to prevent sticking of said metallized iron fines on a surface of said conical portion of said sidewall portion defining said passage.

2. An apparatus according to claim 1 wherein said separator means includes a tangential inlet means for introducing a stream of hot gases ladened with said metallized iron fines, a metallized fine outlet below said tangential inlet and a gas outlet above said metallized fine outlet.

3. An apparatus according to claim 2 wherein said sidewall portion comprises a substantially cylindrical upper portion, a substantially cylindrical lower portion, and a conical intermediate portion connecting said upper portion with said lower portion wherein said tangential inlet means is located in said upper portion, said gas outlet is located in said upper portion and said metallized fines outlet is located in said lower portion.

4. An apparatus according to claim 3 wherein the conical portion of the sidewall forms an angle $\alpha$ of between about 7° to 12° with the lower portion of the sidewall.

5. An apparatus according to claim 4 wherein the conical portion of the sidewall forms an angle $\alpha$ of between about 8° to 10° with the lower portion of the sidewall.

6. An apparatus according to claim 3 wherein said cooling means comprises a chamber formed in at least the conical intermediate portion of said sidewall portion.

7. An apparatus according to claim 6 further including means for feeding a cooling medium under pressure to said chamber.

8. An apparatus according to claim 7 wherein said chamber includes a cooling medium inlet and a cooling medium outlet.

9. An apparatus according to claim 6 wherein said chamber is an elongated annular chamber for cooling substantially all of the conical intermediate portion of said sidewall portion of said separator means.

* * * * *